US005642871A

United States Patent [19]

Repert et al.

[11] Patent Number: 5,642,871

[45] Date of Patent: Jul. 1, 1997

[54] SUSPENDABLE MAGNETIC SOAP HOLDER ASSEMBLY

[75] Inventors: Bruce Repert; Eva Repert, both of Beaverton, Oreg.

[73] Assignee: Constanta Corporation, Beaverton, Oreg.

[21] Appl. No.: 675,735

[22] Filed: Jul. 3, 1996

[51] Int. Cl.[6] ..... A47K 5/04

[52] U.S. Cl. ..... 248/686; 248/683; 248/206.5; 248/309.4; 248/317

[58] Field of Search ..... 248/686, 683, 248/317, 309.4, 206.5

[56] References Cited

U.S. PATENT DOCUMENTS

| | | | |
|---|---|---|---|
| 606,024 | 6/1898 | Deraglie | 248/686 |
| 2,099,484 | 11/1937 | Hokerk . | |
| 2,597,925 | 5/1952 | Edger . | |
| 2,825,177 | 3/1958 | Nordlof et al. . | |
| 3,472,391 | 10/1969 | Bolognesi . | |
| 3,519,568 | 7/1970 | Needleman . | |
| 3,552,705 | 1/1971 | Caster . | |
| 3,693,923 | 9/1972 | Ayoub et al. | 248/317 X |
| 4,207,975 | 6/1980 | Arzillo . | |
| 5,031,759 | 7/1991 | Ogilvie . | |
| 5,368,268 | 11/1994 | Wischat | 248/683 X |
| 5,417,397 | 5/1995 | Harnett . | |

*Primary Examiner*—Robert Canfield

*Attorney, Agent, or Firm*—Chernoff, Villhauer, McClung & Stenzel

[57] ABSTRACT

A suspendable magnetic soap holder assembly for magnetically suspending a bar of soap from a raised holding member includes a flexible suspender interconnected with a first member of a pair of mutually attracting devices and a bar of soap removably interconnected with a second member of the pair of mutually attracting devices. When the flexible suspender is coupled to the raised holding member and the pair of mutually attracting devices are interconnected, the bar of soap is suspended. In one embodiment, the pair of mutually attracting devices are a magnet and a metallic device. A buoyant body may be interposed between the first member and the flexible suspender so that the first member is attached to a bottom side of the buoyant body and the flexible suspender is removably interconnected to the top side of the buoyant body.

18 Claims, 1 Drawing Sheet

SUSPENDABLE MAGNETIC SOAP HOLDER ASSEMBLY

BACKGROUND OF THE INVENTION

The present invention relates to an assembly for magnetically suspending a bar of soap.

Traditional soap holders used in showers and bath tubs are metal, plastic, or ceramic ledges upon which a bar of soap is placed after use. Unfortunately, the bar of soap usually ends up melting or disintegrating in the water that remains in the ledge-type holder. Although some of these ledge-type holders have holes or other drainage apparatus, enough water remains to significantly decrease the life span of the bar of soap. These ledge-type holders also tend to be permanently attached to the wall of the shower or tub and thus cannot be used for travel. Instead, plastic soap boxes are used for travel that, like the ledge-type holders, do not have proper drainage.

Recognizing that a bar of soap would last longer if it was suspended, various embodiments of bars of soap attached to strings have been tried. One such combination shown in Needleman U.S. Pat. No. 3,519,568 is a rope soap in which two ends of a string are embedded in a bar of soap. Another such combination shown in Hokerk U.S. Pat. No. 2,099,484 is a soap with a horizontal opening or bore through which a flexible suspension member is threaded. Soaps suspended by strings have several problems. For example, since the bar of soap comes on the string, choices of brands of soap are limited. Another problem is the waste that is caused because, once the bar of soap is used up, the string is thrown away and another bar of soap and string must be purchased. Still another problem is the inability to adjust the length of the string to accommodate different desired heights. More specifically, if the string is too long, the only remedy is to tie a knot in the string and if the string is too short there is no remedy. Further, if the string is in the way, it cannot be removed at all. Finally, depending on the thickness of the string and the method in which it is attached to the bar of soap, significantly less soap may be available than is evident from the apparent size of the bar.

Another solution is to suspend the bar of soap in a water pervious bag. Ogilvie U.S. Pat. No. 5,031,759 discloses such a soap-holding bag. This invention has several advantages over rope soap such as the fact that any brand of bar of soap may be used and the bag may be reused. Also, the bar of soap may be removed from the bag during use or it may be used within the bag if so desired. However, the bag itself, because it is made of fabric, often requires cleaning. Also, before the bar of soap is dry, the weave of the fabric cuts into the bar of soap.

Soap holders that use magnetic forces to suspend a bar of soap have been suggested in U.S. Patent Nos. 3,472,391, 5,417,397, 3,552,705, and 4,207,975. In each of these patents a piece of metal or a magnet is pressed into or enclosed within a bar of soap. Either a wall-mounted arm or a molded housing has apparatus to attract the embedded metal or magnet so as to suspend the bar of soap. These devices have several problems. Like the ledge-type holders, they are not practical for traveling either because they are permanently attached to a wall or they are cumbersome. Also, since the arms and housings are generally metal, depending on what was under them when they fell, they would sink if they landed in water, damage a tub's ceramic surface, or bruise a toe. Finally, especially for the permanently wall-mounted arms, installation would be difficult and removal would be almost impossible if the device was no longer desired.

SUMMARY OF THE INVENTION

The suspendable magnetic soap holder assembly of the present invention allows a user to use a bar of soap of any preferred brand substantially unencumbered by strings or other external devices. When the user is finished with the bar of soap, it is easily attached to a flexible suspender by a magnet and thereby suspended so that the bar of soap can air dry. The assembly is light-weight and easy to remove so that it is perfect for travel. Its flexible suspender is easily attached to and removed from a raised holding member. Further, the length of the flexible suspending member is easily adjusted to accommodate holding members at any height. Finally, the assembly is lightweight and buoyant so that, if it drops in water it will float, if it drops on tile or ceramic it will not cause damage, and if it drops on a toe it will not bruise it.

According to the present invention, a suspendable magnetic soap holder assembly for magnetically suspending a bar of soap from a raised holding member includes a flexible suspender interconnected with a first member of a pair of mutually attracting devices and a second member of the pair of mutually attracting devices removably interconnected with a bar of soap. When the flexible suspender is coupled to the raised holding member and the pair of mutually attracting devices are interconnected, the bar of soap is suspended.

Preferably, the pair of mutually attracting devices are a magnet and a metallic soap-holding cap. Also, preferably a buoyant body is interposed between the first member and the flexible suspender so that the first member is attached to a bottom side of the buoyant body and the flexible suspender is removably interconnected to a top side of the buoyant body.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
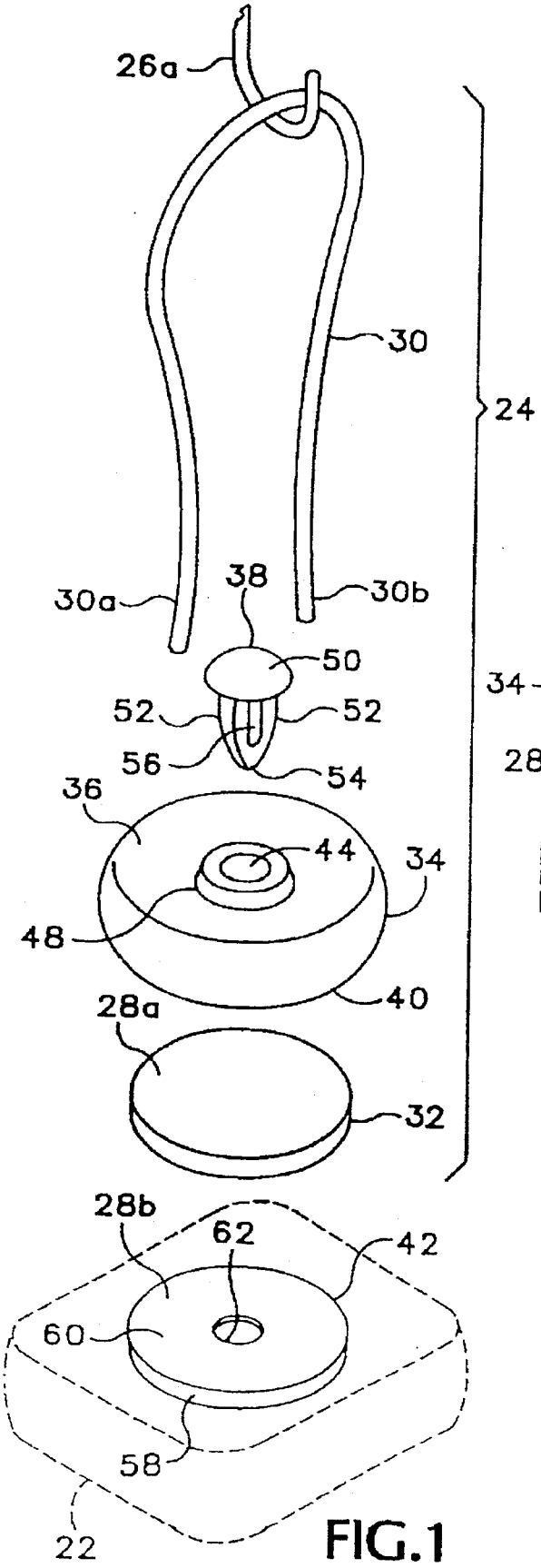
FIG. 1 is an expanded view of a suspended magnetic soap holder assembly of the present invention.
Figure 2:
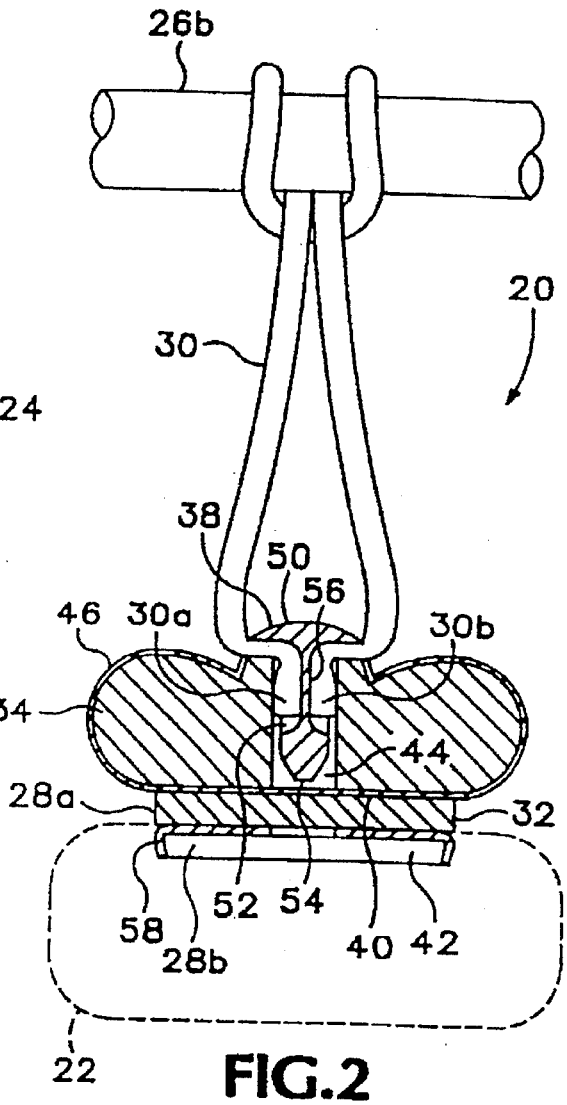
FIG. 2 is a cross sectional view of the soap holder assembly of the present invention suspended from a raised holding member.

FIGS. 1 and 2 show an exemplary embodiment of a suspended magnetic soap holder assembly 20 for magnetically suspending a bar of soap 22 (shown in phantom). The assembly 20 can be divided into to parts that magnetically interconnect. The first part is a suspension part 24 that is connectable to a raised holding member such as a hook **26*a* or a bar 26*b* and includes one member 28*a* of a pair of mutually attracting devices. The second part is the other member 28*b* of the pair of mutually attracting devices that is interconnectable to the bar of soap 22**.

In one embodiment, the suspension part 24 is made up of a flexible suspender 30 that is interconnected with a first member **28*a* of a pair of mutually attracting devices that is shown as a magnet 32. A buoyant body 34 may be interposed between the magnet 32 and the flexible suspender 30. More specifically, the flexible suspender 30 is attached to the top side 36 of the buoyant body 34** using an attaching member 38 and the magnet 32 is attached to the bottom side 40 of the buoyant body 34. In this embodiment, the soap 22 is removably interconnected to a second member 28*b* of the pair of mutually attracting devices that is shown as a metallic soap-holding cap 42. When the flexible suspender 30 is attached to the raised holding member 26*a*, 26*b*, the soap-holding cap 42 is embedded in the bar of soap 22, and the soap-holding cap 42 is magnetically attached to the magnet 32, then the bar of soap 22 is suspended.

As discussed above, a buoyant body 34 may be interposed between the flexible member 30 and the magnet 32. Preferably the buoyant body 34 is an piece of buoyant material having a centrally located cylindrical longitudinal bore 44 or other connection apparatus to accommodate the attaching member 38.

Although the buoyant body may be a STYROFOAM™ member, a plastic bubble or "bobber," or other buoyant member, the preferred embodiment is an essentially doughnut-shaped piece of wood that is approximately 1½ inches in diameter with a waterproof coating 46. The top side 36 of the buoyant body 34 may have a slight annular indentation 48 that assists in the removal of the attaching member 38. Preferably the bottom side 40 of the buoyant member 34 is essentially flat so that it provides a better surface for attaching the magnet 32.

The buoyant body 34 of the preferred embodiment is made of New England Hardwood because of its weight, density, rigidity, and buoyancy. Also, if the suspendable magnetic soap holder assembly 20 falls into water, it will float, making it easy to locate. The buoyant body 34 shown is Wooden Wheel TW150 from Saunders Brothers in the City of Industry, California.

The waterproof coating 46 of the preferred embodiment is a rubber compound such as PLASTIDIP™ into which the buoyant body 34 is dipped. When the coating 46 dries it forms a rubber-like coating that is durable and waterproof. PLASTIDIP™ may be purchased from PDI, Inc. in Circle Pines, Minn. One advantage of this rubber compound is that it provides the option of using different colors without sacrificing durability. Alternatively, the natural wood may be used alone or it may be coated with a lacquer or other waterproof coating.

Turning to the flexible suspender 30, preferably it is removably interconnected with the top side 36 of the buoyant body 34. In a preferred embodiment, to connect the flexible suspender 30 to the buoyant body 34, a first end 30*a* of the flexible suspender 30 and a second end 30*b* of the flexible suspender 30 are inserted into the longitudinal bore 44 and the attaching member 38 is then inserted into the bore 44. The attaching member 38 secures the ends 30*a* and 30*b* of the flexible suspender 30 within the bore 44 of the buoyant body 34. An alternate embodiment attaches only one end 30*a* to the buoyant body 34 and other end 30*b* attaches to a raised holding member 26*a*, 26*b*. By removing the attaching member 38 from the bore 44, the flexible suspender 30 may be detached from the buoyant body 34.

The flexible suspender 30 is also coupleable to the raised holding member 26*a*, 26*b*. As shown in FIG. 1, the flexible suspender 30 may be suspended by a hook 26*a* or other protrusion. FIG. 2 shows the flexible suspender 30 attached to a bar 26*b* such as a shower curtain rod or a towel rack.

In the preferred embodiment, the flexible suspender 30 is a length of braided nylon cord or other durable and flexible material such as chain or elastic. The flexibility of the flexible suspender 30 allows the magnetic force of the magnet 32 to actually pull the flexible suspender 30 toward the soap-holding cap 42 when the bar of soap 22 is in the general vicinity of the magnet 32. Accordingly, if the user has soap in his eyes, all he needs to do to suspend the bar of soap 22 is to get it in the general vicinity of the magnet 32.

As discussed above, the attaching member 38 may be used for removably attaching the flexible suspender 30 to the buoyant body 34. More specifically, in the preferred embodiment the attaching member 38 secures the ends 30*a* and 30*b* of the flexible suspender 30 within the bore 44 of the buoyant body 34. However, alternate embodiments may attach the flexible suspender 30 to the top of the buoyant body 34 using traditional attaching apparatus such as hooks, eyes, or screws.

As shown in FIG. 1, the preferred attaching member 38 is a plastic rivet or arrow clip that includes a slightly rounded attaching cap 50 from which two parallel prongs 52 project in the same direction. The prongs 52 merge to form a single point 54. A thin membrane 56 is dispersed within the opening formed between the attaching cap 50, the prongs 52, and the point 54. In cross section, as shown in FIG. 2, spaces are formed on either side of the membrane 56 to accommodate the ends 30*a* and 30*b* of the flexible suspender 30. Preferably, the prongs 52 are slightly bowed to provide added outward pressure against the annular wall of the bore 44 and thus further securing the flexible suspender 30 to the buoyant body 34. Further securing strength is caused by the attaching member 38 is compressing as it is forced through the bore 44 and then springing back to its essentially original shape once it is within the bore 44. the thin membrane 56 also causes the prongs 52 to press outward.

The attaching member 38 may be removed by gripping the flexible suspender 30 and the buoyant body 34 and pulling them apart. Alternately, a flat blade or screw driver may be inserted under the attaching cap 50 and leveraged upward until the attaching member 38 pops out of the bore 44. The annular indentation 48 is particularly useful for this type of leveraging as it allows better access to the rim of the attaching cap 50. After the attaching member 38 has been removed, the flexible suspender 30 may be cut, replaced, or otherwise adjusted. The attaching member 38 may then be reused to quickly and securely reattach the flexible suspender 30 to the buoyant body 34.

The attaching member 38 of the preferred embodiment is the plastic rivet AC-9 produced by Serv-A-Lite Products, Inc. of Moline, Ill.

As shown in the figures, magnet 32 is attached to the bottom side 40 of the buoyant body 34. Preferably the magnet is a multi-pole magnet with a uniform magnetic field such as PSM 50 that may be purchased from Mastermagnetics, Inc. in Castle Rock, Colo. It should be noted that any magnet could be used that has sufficient strength, durability, and will not corrode or lose its shape due to exposure to water. Ideally, however, the magnet 32 is a one-inch disk that is permanently affixed to the bottom side 40 of the buoyant body 34. In one embodiment the magnet 32 has a thin aluminum sheet (not shown) with adhesive (not shown) on both sides that separates the magnet 32 from the buoyant body 34.

The soap-holding cap 42, as shown in FIGS. 1 and 2, is removably interconnectable with the bar of soap 22. The soap-holding cap 42 is connected to the bar of soap 22 by pressing the annular rounded side 58 of the soap-holding cap 42 into the bar of soap 22 so that the 0-shaped flat metal disk portion 60 of the soap-holding cap 42 is flush with the surface of the bar of soap 22. Since the soap-holding cap 42 preferably has a smooth finish and is flush with the surface of the bar of soap 22, the soap-holding cap 42 is unobtrusive when the bar of soap 22 is being used. When the bar of soap 22 has been used down to the thickness of the soap-holding cap 42 (or at any time at which the soap-holding cap needs to be removed), the soap-holding cap 42 may be disconnected or removed from the bar of soap 22 by pressing on a portion of the bar of soap 22 exposed through an opening 62 defined in the O-shaped flat metal disk portion 60 of the soap-holding cap 42. The opening 62 also serves to prevent air pressure from building between the soap-holding cap 42 and the bar of soap 22 during installation.

Preferably, the soap-holding cap 42 is a metallic disc that is smoothed by a tumbling process, and then plated with electroless nickel. The annular rounded side 58 is approximately ⅛ inch high which is just deep enough to create a maximum holding power. Also, since the annular rounded side 58 is angled inward, slightly concave, or beveled, the soap-holding cap 42 securely grips the bar of soap 22 and prevents a rough edge from appearing when soap is used to the point of exposure of rounded side 58. The soap-holding cap 42 of the preferred invention is metal cap 90-361 that may be purchased from Satco in Brentwood, N.Y. East Side Metal Plating in Portland, Oregon provides a service for plating the soap-holding cap 42 with electroless nickel.

Once the soap-holding cap 42 has been inserted into the bar of soap 22, it can be magnetically connected with the magnet 32 of the suspension part 24 of the assembly 20. Assuming that the flexible suspender 30 has been attached to a raised holding member **26*a*, 26*b*, the bar of soap 22 is suspended when the soap-holding cap 42 is magnetically attracted and then attached to the magnet 32. The bar of soap 22 is released from the suspension part 24 when a user pulls the bar of soap 22 away. The bar of soap 22 may be replaced by holding it near the suspension part 24 that, because of the flexible nature of the flexible suspender 30, is magnetically attracted to the embedded soap-holding cap 42**.

As discussed above, the suspension part 24 includes one member **28*a* of a pair of mutually attracting devices and the part that interconnects with the bar of soap 22 is the other member 28*b* of the pair of mutually attracting devices. As mentioned above, in the preferred embodiment the magnet is attached to the bottom side 40 of the buoyant body 34 and a piece of metal such as the metallic soap-holding cap 42 is removably interconnectable with the bar of soap 22. However, it should be noted that an alternate embodiment embeds the magnet 32 within the bar of soap and attaches the piece of metal to the bottom side 40 of the buoyant body 34**.

Further, it should be noted that the magnet 32 and metallic soap-holding cap 42 are just one example of the pair of mutually attracting devices **28*a*, 28*b*. Alternatively, the pair of mutually attracting devices 28*a*, 28*b*** could be any two part apparatus that removably interconnect such as the two sides of hook and loop material (commonly known as VELCRO™), a hook and eye combination, two sides of a snap, and other two-part connectors.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for magnetically suspending a bar of soap from a raised holding member, said apparatus comprising:

(a) a buoyant body having a top side and a bottom side;

(b) a magnet attached to said bottom side of said buoyant body;

(c) a flexible suspender removably interconnected with said top side of said buoyant body, said flexible suspender adapted to be releaseably coupled to said raised holding member; and (d) a metallic soap-holding cap adapted to be removably interconnectable with said bar of soap, said soap-holding cap magnetically interconnecting with said magnet.

2. The apparatus of claim 1 further comprising a attaching member for removably attaching said flexible suspender to said buoyant body.

3. The apparatus of claim 2, said attaching member further comprising:

(a) an attaching cap;

(b) two parallel prongs projecting in the same direction from said attaching cap, said prongs merging to form a single point; and (c) a thin membrane between said attaching cap, said prongs, and said point.

4. The apparatus of claim 1 wherein said flexible suspender has a first end and a second end, said first end and said second end removably attach to said top side of said buoyant body.

5. The apparatus of claim 1 wherein said buoyant body is wood.

6. The apparatus of claim 1 wherein said buoyant body has a waterproof coating.

7. The apparatus of claim 1 wherein said buoyant body is a rubber-coated O-shaped piece of wood.

8. The apparatus of claim 1 wherein said flexible suspender is a length of braided nylon cord.

9. The apparatus of claim 1 wherein said magnet is a multi-pole magnet.

10. The apparatus of claim 1 wherein said holding cap has an opening defined therein.

11. An apparatus for magnetically suspending a bar of soap from a raised holding member, said apparatus comprising:

(a) a magnet;

(b) a flexible suspender interconnected with said magnet, said flexible suspender adapted to be releaseably coupled to said raised holding member; and (c) a metallic soap-holding cap adapted to be removably interconnectable with said bar of soap, said soap-holding cap magnetically interconnected with said magnet.

12. The apparatus of claim 11, further comprising a buoyant body interposed between said magnet and said flexible suspender.

13. An apparatus for suspending a bar of soap from a raised holding member, said apparatus comprising:

(a) a pair of mutually attracting devices;

(b) a flexible suspender removably interconnected with a first member of said pair of mutually attracting devices, said flexible suspender connectable to said raised holding member; and (c) a second member of said pair of mutually attracting devices being removably interconnectable with said bar of soap.

14. The apparatus of claim 13 wherein said pair of mutually attracting devices are a magnet and metal device.

15. The apparatus of claim 13 wherein a buoyant body is interposed between said flexible suspender and said first member.

16. The apparatus of claim 13 wherein said pair of mutually attracting devices are a magnet and metallic device, and a buoyant body having a bottom side is interposed between said flexible suspender and said first member.

17. The apparatus of claim 16 wherein said magnet is attached to said bottom side of said buoyant body and said metallic device is removably interconnectable with said bar of soap.

18. The apparatus of claim 16 wherein said metallic device is attached to said bottom side of said buoyant body and said magnet is removably interconnectable with said bar of soap.

* * * * *